US010240396B2

(12) United States Patent
Janes et al.

(10) Patent No.: US 10,240,396 B2
(45) Date of Patent: Mar. 26, 2019

(54) FLOW CONTROL MODULE FOR A ROTARY STEERABLE DRILLING ASSEMBLY

(71) Applicant: Halliburton Energy Services, Inc., Houston, TX (US)

(72) Inventors: Stephen Christopher Janes, Houston, TX (US); Daniel Martin Winslow, Spring, TX (US); Neelesh V. Deolalikar, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 48 days.

(21) Appl. No.: 15/022,027

(22) PCT Filed: May 21, 2015

(86) PCT No.: PCT/US2015/031927
§ 371 (c)(1),
(2) Date: Mar. 15, 2016

(87) PCT Pub. No.: WO2016/186672
PCT Pub. Date: Nov. 24, 2016

(65) Prior Publication Data

US 2017/0159362 A1 Jun. 8, 2017

(51) Int. Cl.
*E21B 34/06* (2006.01)
*E21B 7/06* (2006.01)

(52) U.S. Cl.
CPC ..... *E21B 7/068* (2013.01); *E21B 34/06* (2013.01)

(58) Field of Classification Search
CPC ... E21B 4/02; E21B 7/06; E21B 21/10; F03B 13/02
See application file for complete search history.

(56) References Cited

U.S. PATENT DOCUMENTS 5,695,015 A 12/1997 Barr et al.
6,092,610 A * 7/2000 Kosmala ..... E21B 4/20 175/27

(Continued)

FOREIGN PATENT DOCUMENTS

EP 1106777 A1 6/2001
WO 2014098900 A1 6/2014
WO 2014177502 A1 11/2014

OTHER PUBLICATIONS

International Search Report and Written Opinion for PCT/US2015/031927 dated Feb. 19, 2016.

*Primary Examiner* — David J Bagnell
*Assistant Examiner* — Brandon M Duck
(74) *Attorney, Agent, or Firm* — Alan Bryson; C. Tumey Law Group PLLC

(57) ABSTRACT

Directional control of a rotary steerable drilling assembly can be facilitated by a flow control module for maintaining a geostationary position or orientation of components of the assembly. The drilling assembly can include a bit shaft and an offset mandrel for adjusting a longitudinal axis of the bit shaft. A drive mechanism can rotate the offset mandrel independently of the bit shaft to maintain the offset mandrel in a geostationary position or orientation relative to a formation of the earth and/or a wellbore. A flow control module controllably directs a fluid flow to the drive mechanism. The flow control module can include an inner body and an outer body, defining an annulus there between and one or more blades within the annulus, each of the blades being rotatable to provide a range of angles with respect to a longitudinal axis of the flow control module.

23 Claims, 6 Drawing Sheets

(56) References Cited

U.S. PATENT DOCUMENTS

| | | | | |
|---|---|---|---|---|
| 8,297,375 | B2 | 10/2012 | Hall et al. | |
| 8,408,336 | B2 | 4/2013 | Hall et al. | |
| 2009/0229883 | A1* | 9/2009 | Hall | E21B 4/02 175/107 |

* cited by examiner

FLOW CONTROL MODULE FOR A ROTARY STEERABLE DRILLING ASSEMBLY

This application is a national stage application of PCT Patent Application No. PCDT/US2015/031927 by Stephen Christopher Janes, filed on May 21, 2015, entitled Flow Control Module for a Rotary Steerable Drilling Assembly.

BACKGROUND

The application relates generally to well drilling operations and, more particularly, to directional control of a rotary steerable drilling assembly using a flow control module.

As well drilling operations become more complex, and hydrocarbon reservoirs more difficult to reach, the need to precisely locate a drilling assembly, both vertically and horizontally, in a formation increases. Parts of some well drilling operations require steering the drilling assembly, either to avoid particular formations or to intersect formations of interest. Steering the drilling assembly includes changing the direction in which the drilling assembly/drill bit is pointed. Traditional mechanisms for steering the drilling assembly are typically complex and expensive, and may require engagement of the borehole with extendable engagement mechanisms that can be problematic when they must pass through important mechanisms, such as blowout preventers, that can be crucial for safety during drilling operations.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The application relates generally to well drilling operations and, more particularly, to directional control of a rotary steerable drilling assembly using a flow control module.

According to one or more embodiments, mechanisms can be provided for controlling the direction of a drilling assembly within a borehole. An exemplary system may include a housing and a flow control module within the housing. A fluid-controlled drive mechanism may be in fluid communication with the flow control module. Additionally, an offset mandrel may be coupled to an output of the fluid-controlled drive mechanism. The offset mandrel may be independently rotatable with respect to the housing. According to one or more embodiments, the system may also include a bit shaft pivotably coupled to the housing. The bit shaft may be coupled to an eccentric receptacle of the offset mandrel, and the housing may be configured to impart torque on the bit shaft. As will be described below, the bit shaft may be coupled to a drill bit, and the torque imparted on the bit shaft by the housing may drive the drill bit. The fluid-controlled drive mechanism may counter-rotate the offset mandrel with respect to the housing, which may maintain an angular orientation of the offset mandrel, bit shaft, and drill bit with respect to the surrounding formation during drilling operations. The counter-rotation speed of the offset mandrel may be varied by controlling the speed of the fluid-controlled drive mechanism. The speed of the fluid-controlled drive mechanism may be controlled by varying a flow of drilling fluid within the flow control module, with which the flow-controlled drive mechanism is in fluid communication. The flow can be controlled by varying the speed and/or direction thereof as it contacts the drive mechanism. Such adjustments can be made without requiring alteration of the volumetric flow rate of the fluid.

Figure 1A:
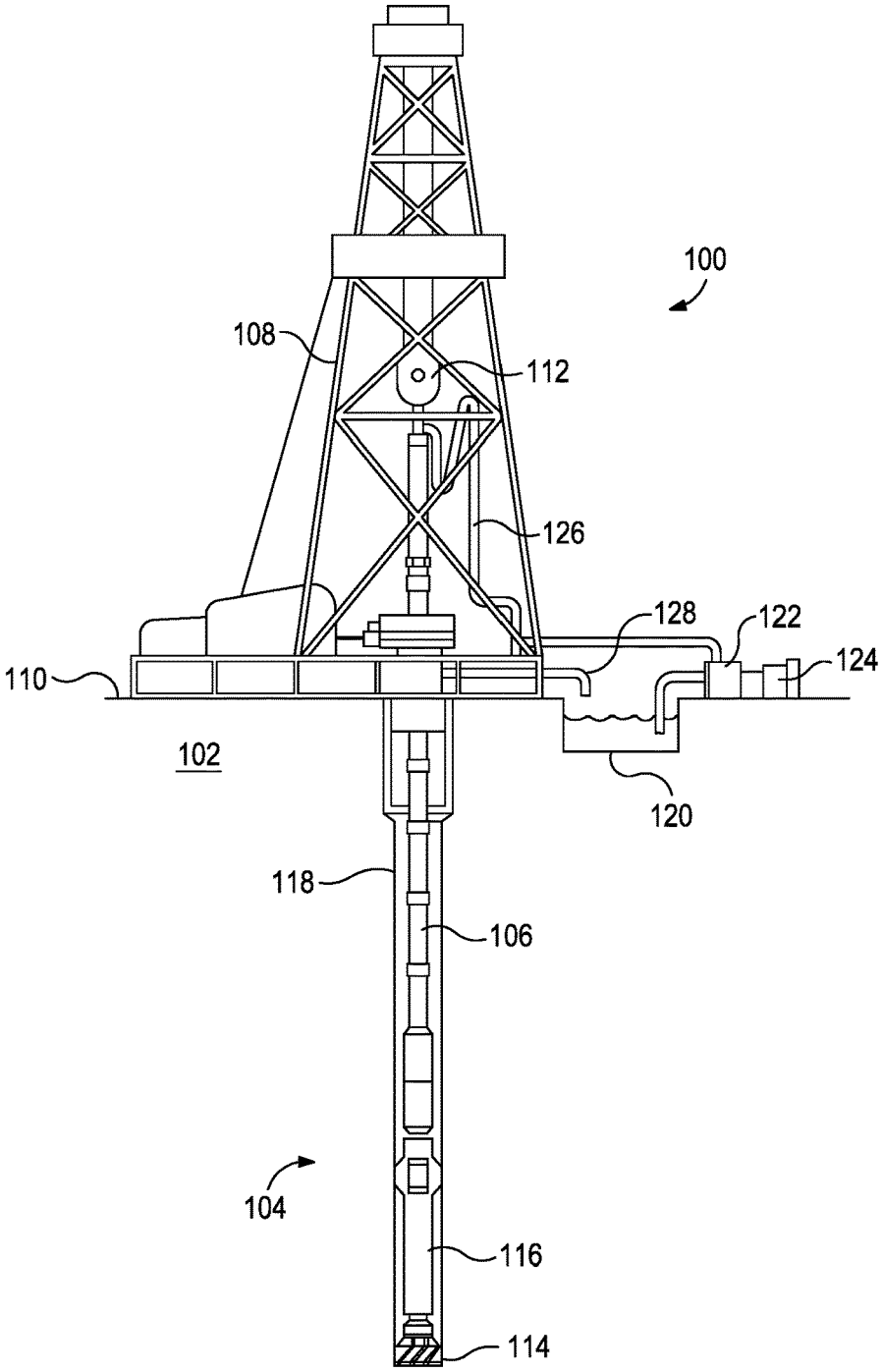
FIG. 1A shows a diagram of an exemplary drilling system, according to one or more embodiments of the present disclosure.

Referring to FIG. 1A, illustrated is an exemplary drilling system 100 that may employ one or more principles of the present disclosure. Boreholes may be created by drilling into the earth 102 using the drilling system 100. The drilling system 100 may be configured to drive a bottom hole assembly (BHA) 104 positioned or otherwise arranged at the bottom of a drill string 106 extended into the earth 102 from a derrick or rig 108 arranged at the surface 110. The derrick 108 includes a traveling block 112 used to lower and raise the drill string 106.

The BHA 104 may include a drill bit 114 operatively coupled to a tool string 116 which may be moved axially within a drilled wellbore 118 as attached to the drill string 106. During operation, the drill bit 114 penetrates the earth 102 and thereby creates the wellbore 118. The BHA 104 provides directional control of the drill bit 114 as it advances into the earth 102. The tool string 116 can be semi-permanently mounted with various measurement tools (not shown) such as, but not limited to, measurement-while-drilling (MWD) and logging-while-drilling (LWD) tools, that may be configured to take downhole measurements of drilling conditions. In other embodiments, the measurement tools may be self-contained within the tool string 116, as shown in FIG. 1A.

Fluid or "mud" from a mud tank 120 may be pumped downhole using a mud pump 122 powered by an adjacent power source, such as a prime mover or motor. The mud may be pumped from the mud tank 120, through a standpipe 126, which feeds the mud into the drill string 106 and conveys the same to the drill bit 114. The mud exits one or more nozzles arranged in the drill bit 114 and in the process cools the drill bit 114. After exiting the drill bit 114, the mud circulates back to the surface 110 via the annulus defined between the wellbore 118 and the drill string 106, and in the process, returns drill cuttings and debris to the surface. The cuttings and mud mixture are passed through a flow line 128 and are processed such that a cleaned mud is returned down hole through the standpipe 126 once again.

Although the drilling system 100 is shown and described with respect to a rotary drill system in FIG. 1A, those skilled in the art will readily appreciate that many types of drilling systems can be employed in carrying out embodiments of the disclosure. For example, drills and drill rigs used in embodiments of the disclosure may be used onshore (as depicted in FIG. 1A) or offshore (not shown). Offshore oilrigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

While not specifically illustrated, those skilled in the art will readily appreciate that the BHA 104 may further include various other types of drilling tools or components such as, but not limited to, a steering unit, one or more stabilizers, one or more mechanics and dynamics tools, one or more drill collars, one or more accelerometers, one or more magnetometers, and one or more jars, and one or more heavy weight drill pipe segments.

Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons.

Figure 1B:
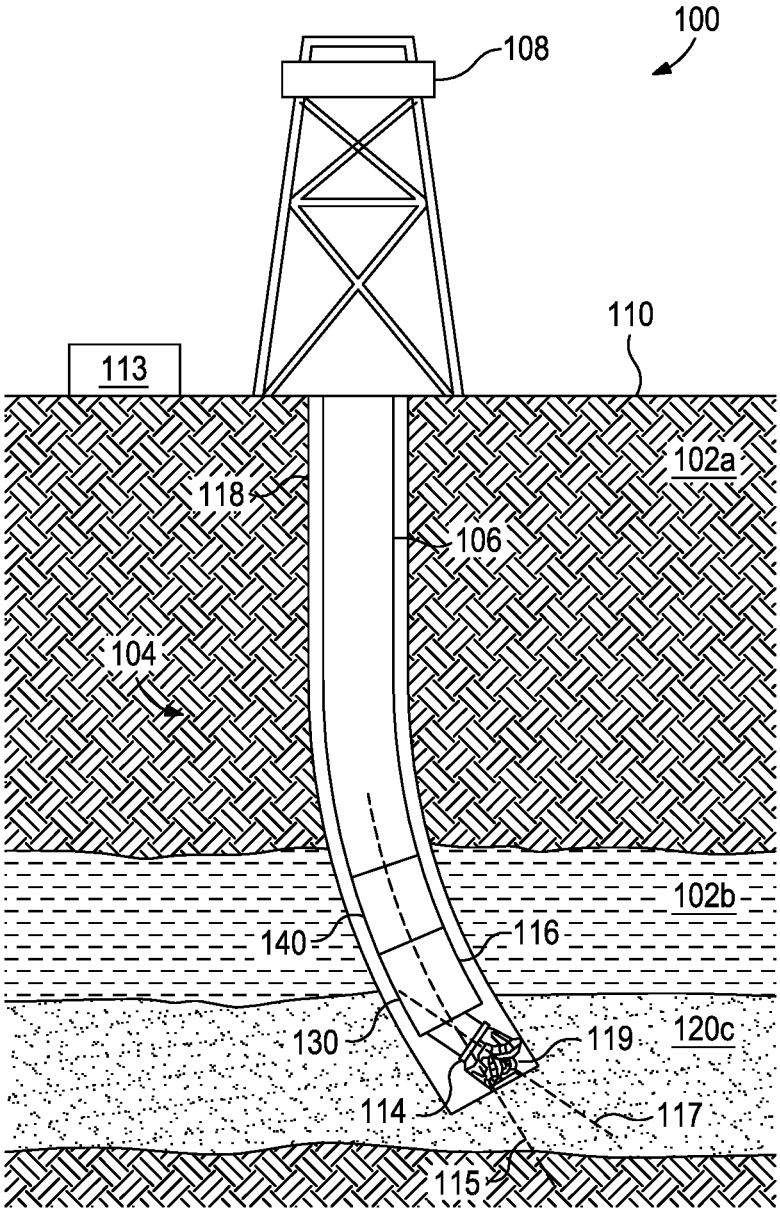
FIG. 1B shows a diagram of an exemplary drilling system, according to one or more embodiments of the present disclosure.

Referring now to FIG. 1B, with continued reference to FIG. 1A, illustrated is an exemplary bottom hole assembly (BHA) 104 of an exemplary drilling system 100 that can be used in accordance with one or more embodiments of the present disclosure. The drilling system 100 includes the derrick 108 mounted at the surface 110 and positioned above the wellbore 118 that extends within first, second, and third subterranean formations 102*a*, 102*b*, and 102*c* of the earth 102. In the embodiment shown, a drilling system 100 may be positioned within the wellbore 118 and may be coupled to the derrick 108. The BHA 104 may include a drill bit 114, a measurement-while-drilling (MWD) apparatus 140 and a steering assembly 130. The steering assembly 130 may control the direction in which the wellbore 118 is being drilled. As will be appreciated by one of ordinary skill in the art in view of this disclosure, the wellbore 118 can be drilled in the direction perpendicular to the tool face 119 of the drill bit 114, which corresponds to the longitudinal axis 117 of the drill bit 114. Accordingly, controlling the direction of the wellbore 118 may include controlling the angle between the longitudinal axis 117 of the drill bit 114 and longitudinal axis 115 of the steering assembly 130, and controlling the angular orientation of the drill bit 114 relative to the earth 102.

According to one or more embodiments, the steering assembly 130 may include an offset mandrel (not shown in FIG. 1B) that causes the longitudinal axis 117 of the drill bit 114 to deviate from the longitudinal axis 115 of the steering assembly 130. The offset mandrel may be counter-rotated relative to the rotation of the drill string 106 to maintain an angular orientation of the drill bit 114 relative to the earth 102.

According to one or more embodiments, the steering assembly 130 may receive control signals from a control unit 113. According to one or more embodiments, as shown in FIG. 1B, the control unit 113 can be located at a surface 110 and placed in communication with operating components of the BHA 104. Alternatively or in combination, the control unit 113 can be located within or along a section of the BHA 104. The control unit 113 may include an information handling system with a processor and a memory device, and may communicate with the steering assembly 130 via a telemetry system. According to one or more embodiments, as will be described below, the control unit 113 may transmit control signals to the steering assembly 130 to alter the longitudinal axis 115 of the drill bit 114 as well as to control counter-rotation of portions of the offset mandrel to maintain the angular orientation of the drill bit 114 relative to the earth 102. As used herein, maintaining the angular orientation of a drill bit relative to the earth 102 may be referred to as maintaining the drill bit in a "geo-stationary" position. According to one or more embodiments, a processor and memory device may be located within the steering assembly 130 to perform some or all of the control functions. Moreover, other BHA 104 components, including the MWD apparatus 140, may communicate with and receive instructions from control unit 113.

According to one or more embodiments, the drill string 106 may be rotated to drill the wellbore 118. The rotation of the drill string 106 may in turn rotate the BHA 104 and the drill bit 114 with the same rotational direction and speed. The rotation may cause the steering assembly 130 to rotate about its longitudinal axis 115, and the drill bit 114 to rotate around its longitudinal axis 117 and the longitudinal axis 115 of the steering assembly 130. The rotation of the drill bit 114 about its longitudinal axis 117 may be desired to cause the drill bit 114 to cut into the formation. The rotation of the drill bit 114 about the longitudinal axis 115 of the steering assembly 130 may be undesired in certain instances, as it changes the angular orientation of the drill bit 114 relative to the earth 102. For example, when the longitudinal axis 117 of the drill bit 114 is at an angle from the longitudinal axis of the drill string 115, as it is in FIG. 1B, the drill bit 114 may rotate about the longitudinal axis 115 of the steering assembly 130, preventing the drilling assembly from drilling at a particular angle and direction to the tool face.

Figure 2A:
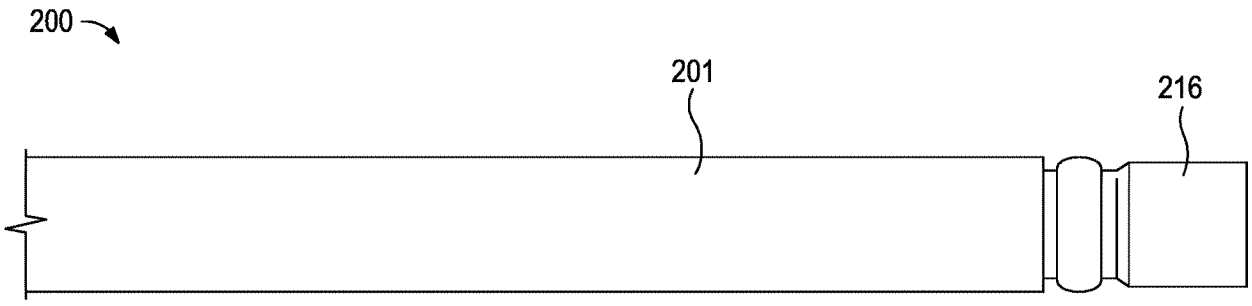
FIG. 2A shows a side view of an exemplary drilling system, according to one or more embodiments of the present disclosure.

FIG. 2 is a diagram illustrating an exemplary steering assembly 200, according to one or more embodiments, that may be used, in part, to maintain a drill bit in a geostationary position during drilling operations. FIG. 2 depicts illustrative portions of the steering assembly 200. The steering assembly 200 may include a housing 201 that may be coupled directly or indirectly to a drill string, such as through an MWD apparatus. The housing 201 may include separate segments or may include a single unitary housing. According to one or more embodiments, as will be described below, each of the segments may correspond to a separate instrument portion of the steering assembly 200. For example, a section of the housing 201 may house the control mechanisms, and may communicate with a control unit at the surface and/or receive control signals from the surface and control mechanisms within the steering assembly. According to one or more embodiments, the control mechanisms may include a processor and a memory device, and may receive measurements from position sensors within the steering assembly, such as gravity toolface sensors that may indicate a drilling direction. By further example, a section of the housing 201 may house drive elements, including a flow control module 300 and a flow-controlled drive mechanism 209. By further example, a section of the housing 201 may house a flow control module 300 for controlling characteristics of the flow provided to the flow-controlled drive mechanism 209. By further example, a section of the housing 201 may house steering elements that control the drilling angle and orientation, relative to a longitudinal axis, of a drill bit coupled to bit shaft 216 of the steering assembly 200.

According to one or more embodiments, the steering assembly 200 may be coupled, directly or indirectly, to a drill string, through which drilling fluid may be pumped during drilling operations. The drilling fluid may flow through ports 204 into an annulus 205 around a flow control module 300. Once beyond the annulus 205 and through an outlet 206 of the flow control module 300, the drilling fluid may either flow to a fluid-controlled drive mechanism 209. Alternatively, according to one or more embodiments, the drilling fluid may be diverted to a bypass annulus (not shown). The flow control module 300 may control the amount, speed, and trajectory of drilling fluid flow that enters the fluid-controlled drive mechanism 209.

According to one or more embodiments, the fluid pathway from port 204 to an inner annulus 208 of the fluid-controlled drive mechanism 209 may include the flow control module 300, with the inner annulus 208 of the fluid-controlled drive mechanism 209 being in fluid communication with the flow control module 300 via the outlet 206. The flow control module 300 may be configured to vary or change the fluid flow to the fluid-controlled drive mechanism 209. According to one or more embodiments, the rotational speed of the fluid-controlled drive mechanism 209 may be controlled by the mass, direction, speed, and volumetric flow rate of drilling fluid that flows into the inner annulus 208. According to one or more embodiments, the flow control module 300, therefore, may be used to control the rotational speed of the fluid-controlled drive mechanism 209 by varying the amount, direction, speed, and/or volumetric flow rate of drilling fluid that flows into the inner annulus 208. As would be appreciated by one of ordinary skill in the art in view of this disclosure, other variable flow fluid pathways are possible, using a variety of valve configurations that may meter the flow of drilling fluid across a fluid-controlled drive mechanism.

As described above, the steering assembly 200 may include a fluid-controlled drive mechanism 209 in fluid communication with the flow control module 300 via the inner annulus 208. In the embodiment shown, the fluid-controlled drive mechanism 209 can include a turbine, but other fluid-controlled drive mechanisms are possible, including but not limited to a mud motor. The turbine 209 may include a plurality of rotors and stators that generate rotational movement in response to fluid flow within the inner annulus 208. The turbine 209 may generate rotation at an output shaft 211, which may be coupled, directly or indirectly, to an offset mandrel 212. According to one or more embodiments, a speed reducer (not shown) may be placed between the turbine 209 and the output shaft 211 to reduce the rate of rotation generated by the turbine 209.

According to one or more embodiments, a generator 214 may be coupled to the fluid-controlled drive mechanism 209. In the embodiment shown, the generator 214 may be magnetically coupled to a rotor 209*a* of the turbine 209. The generator 214 may include a wired stator 214*a*. The wired stator 214*a* may be magnetically coupled to a rotor 209*a* of the rotor 209 via magnets 215 coupled to the rotor 209*a*. As the drive mechanism 209 rotates, so does the rotor 209*a*, which may cause the magnets 215 to rotate around the wired stator 214*a*. This may generate an electrical current within the generator 214, which may be used to power a variety of control mechanisms and sensors located within the steering assembly 200, including control mechanisms for the flow control module 300.

The output shaft 211 may be coupled, directly or indirectly, to the offset mandrel 212. The output shaft 211 may impart rotation from the turbine 209 to the offset mandrel 212, such that the offset mandrel 212 may be rotated independently from the housing 201. The offset mandrel 212 may be coupled to the output shaft 211 at a first end and may include an eccentric receptacle 217 at a second end. The bit shaft 216 may be at least partially disposed within the eccentric receptacle 217. The eccentric receptacle 217 may be used to alter or maintain a longitudinal axis 219 of the bit shaft 216 and a drill bit (not shown) coupled to the bit shaft 216.

The bit shaft 216 may be pivotally coupled to the housing 201 at pivot point 218. As can be seen, the bit shaft 216 may pivot about the pivot point 218 to alter a longitudinal axis 219 of the bit shaft 216. According to one or more embodiments, the eccentric receptacle 217 may cause the bit shaft 216 to pivot about pivot point 218, which may offset the longitudinal axis 219 of the shaft 216 relative to the longitudinal axis 220 of the steering assembly 200. According to one or more embodiments, additional eccentric receptacles (not shown) may be employed to cause the bit shaft 216 to pivot about pivot point 218. In addition to allowing the bit shaft 216 to pivot relative to the housing 201, the pivot point 218 may also be used to impart torque from the housing 201 to the bit shaft 216. The torque may be imparted to a drill bit (not shown) that is coupled to the bit shaft 216 and that may share the longitudinal axis 219 of the bit shaft 216. The longitudinal axis 219 of the bit shaft 216 may therefore correspond to a drilling angle of the steering assembly 200 by operation of eccentric receptacles.

During drilling operations, a drill string coupled to the housing 201 may be rotated, causing the housing 201 to rotate around the longitudinal axis 220. The rotation of the housing 201 may be imparted to the bit shaft 216 as torque through pivot point 218 using balls 290 or a CV joint. The torque may cause the bit shaft 216 to rotate about its longitudinal axis 219 as well as the longitudinal axis 220 of the steering assembly 200. When the longitudinal axis 219 of the bit shaft 216 is offset relative to the longitudinal axis 220 of the steering assembly 200, this may cause the end of the bit shaft 216 to rotate with respect to the longitudinal axis 220, changing the angular direction of the bit shaft 216 and corresponding bit with respect to the surrounding formation(s) of the earth 102. Accordingly, the longitudinal axis 219 of the bit shaft 216 may be fixed relative to the longitudinal axis 220 of the steering assembly 200 by the configuration of the eccentric end 217 of the offset mandrel 212. Alternatively, a drilling angle can be varied by altering a longitudinal axis 219 of the bit shaft 216 relative to the longitudinal axis 220 of the steering assembly 200.

According to one or more embodiments, to permit accuracy of downhole steering of the rotary steerable drilling system, the precise position of the rotary components of the drilling tool establish a known position index from which steering correction is determined. As such, it can be desirable that position-indicating sensors be located in geostationary relation with respect to the rotary drive system for the bit shaft. According to one or more embodiments, the system electronics and the various system control components can be counter-rotated, by a turbine and flow control module, at the same rotational speed as that of the tool collar so that the electronics and system control components are essentially geostationary during drilling operations.

According to one or more embodiments, the offset mandrel 212 may be counter-rotated relative to the housing 201 to maintain the angular orientation of the bit shaft 216. For example, a drill string may be rotated in a first direction at a first speed, causing the steering assembly 200 to rotate at the first direction and the first speed. To maintain the angular orientation of the bit shaft 216 with respect to the surrounding formation, the flow control module 300 may be controlled to allow a flow of drilling fluid across the fluid-controlled drive mechanism 209 such that the offset mandrel 212 is rotated in a second direction, opposite the first direction, at a second speed, the same as the first speed. With the offset mandrel 212 rotating opposite the housing 201 at the same speed, the eccentric end 217 of the offset mandrel 212 may remain stationary with respect to the surrounding formation (geo-stationary), maintaining the angular orientation of the bit shaft 216 relative to the formation while still allowing the bit shaft 216 to rotate about its longitudinal axis 219. Likewise, the angular orientation of the bit shaft 216 may be controllably altered relative to the surrounding formation(s) by rotating the offset mandrel 212 at any other speed than the rotational speed of the housing 201.

Figure 2B:
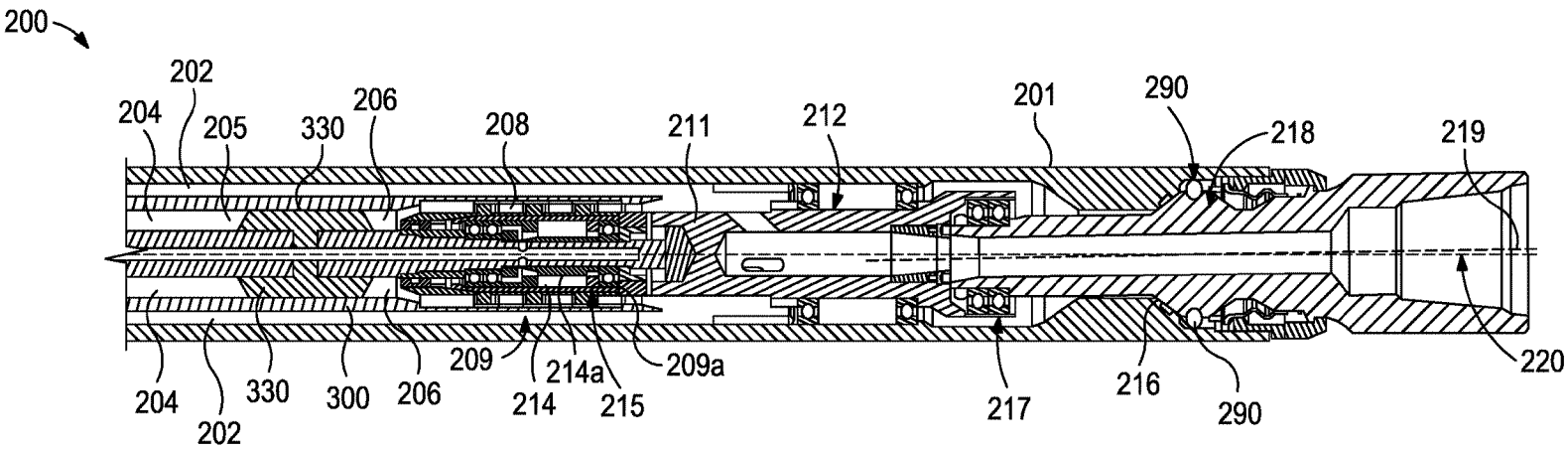
FIG. 2B shows a sectional view of an exemplary drilling system, according to one or more embodiments of the present disclosure.
Figure 2C:
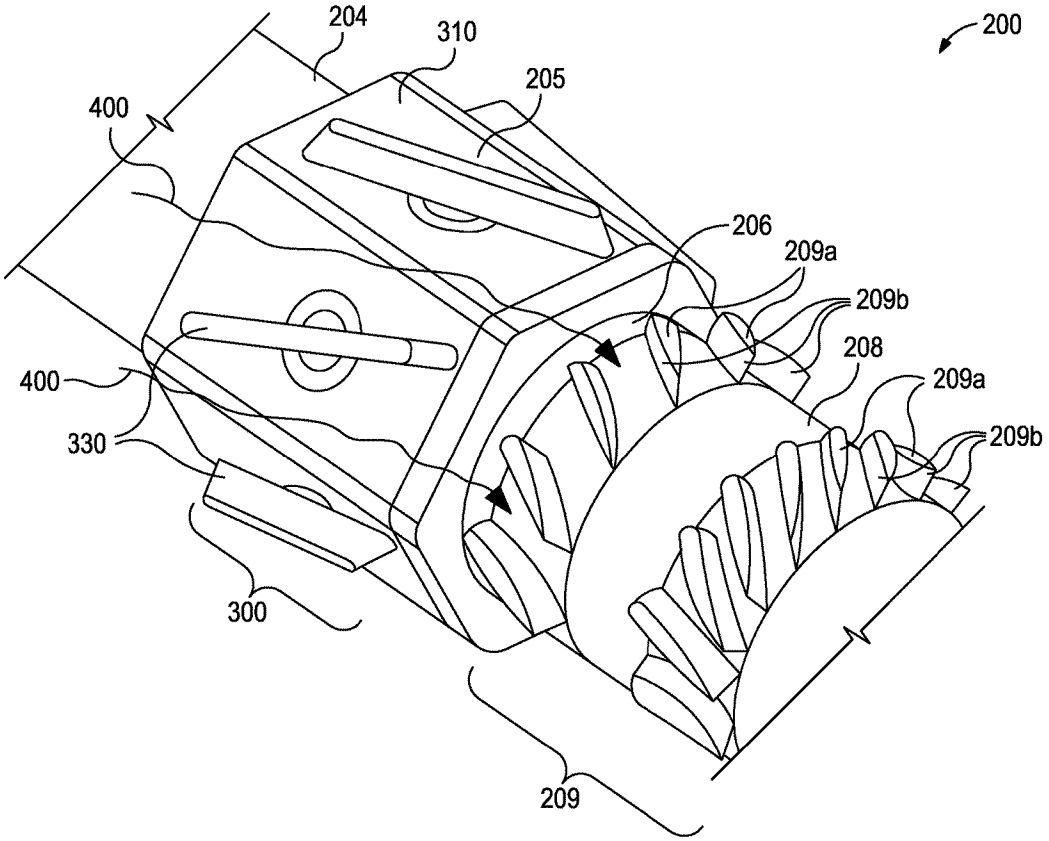
FIG. 2C shows a perspective view of a portion of an exemplary drilling system, according to one or more embodiments of the present disclosure.

According to one or more embodiments, as shown in FIG. 2C, the flow control module 300 can direct a flow 400 of a fluid at a desired speed and direction based on operation of the flow control module 300. As shown, the blades 330 of the flow control module 300 can be oriented in a manner that determines the size and direction of a flow passage through the annulus 205 and between the blades 330. The flow 400 is directed by the blades 330 to the outlet 206 to interact with the rotors 209*a* of the drive mechanism 209.

According to one or more embodiments, drilling fluid 400 is depicted flowing down the drill string and engaging the drive mechanism 209. Adjusting the rotational orientation of the blades 330 changes the downwash angle that the drilling fluid 400 will engage the drive mechanism 209. Changing the downwash angle causes the drive mechanism 209 to travel at different speeds. This method can be used to slow down or speed up the drive mechanism 209 or to increase or decrease the torque from the drive mechanism 209. When the blades 330 are substantially aligned (e.g., parallel) with the receiving faces 209*b* of the rotors 209*a*, a larger angle of incidence relative to the receiving faces 209*b* of the rotors 209*a* is created, such that the drilling fluid 400 may flow past the rotors 209*a* without having substantial impact thereon. Alternatively, when the blades 330 are oriented transverse to the receiving faces 209*b* of the rotors 209*a*, as shown in FIG. 2C, a smaller angle of incidence (e.g., directly orthogonal) relative to the receiving faces 209*b* of the rotors 209*a* is created, and a greater torque is applied to the rotors 209*a*, rotating the drive mechanism 209 at a faster speed. The drive mechanism 209 turns faster in this case due to increased force transmission than it would when the blades 330 are substantially aligned (e.g., parallel) with the receiving faces 209*b* of the rotors 209*a*.

According to one or more embodiments, adjusting the rotational orientation of the blades 330 changes a total axial cross-sectional flow area for the fluid 400 to pass through the annulus 205. Changing the cross-sectional flow area through the annulus 205 alters the speed of the drilling fluid 400, thereby causing the drive mechanism 209 to travel at different speeds as the drilling fluid 400 contacts the rotors 209*a* of the drive mechanism 209. According to one or more embodiments, by changing the area of exposure, the fluid encounters increased resistance and is forced to flow through a bypass 202, if present. If no bypass 202 is present, then the changing area of exposure yields different fluid velocities for different blade angles, thereby causing corresponding performance characteristics. By changing the blade orientation, the inlet angle of the fluid to the rotor changes, thereby changing the performance characteristics. This method can be used to slow down or speed up the drive mechanism 209 or to increase or decrease the torque from the drive mechanism 209. Furthermore, the flow speed of the drilling fluid 400 and the speed of the drive mechanism 209 can be altered without altering the volumetric flow rate of the drilling fluid 400. For example, for a given volumetric flow rate, the flow speed of the drilling fluid 400 can be modified by changing the cross-sectional flow area for the fluid 400 pass through the annulus 205. Accordingly, the speed of the drive mechanism 209 can be controlled without requiring alterations to the volumetric flow rate of the drilling fluid 400.

According to one or more embodiments, as shown in FIG. 2B, a flow pathway 202 can be provided in fluid communication with port 204, which leads to the flow control module 300. The flow pathway 202 can be arranged annularly about the flow control module 300 or otherwise arranged to provide fluid flowing toward the flow control module 300 alternate pathway along the axis. According to one or more embodiments, the flow pathway 202 can maintain a constant level of resistance against flow therethrough. According to one or more embodiments, as a rotational orientation of the blades 330 changes, a total axial cross-sectional flow area for the fluid 400 to pass through the annulus 205 can change, thereby increasing or decreasing flow resistance through the flow control module 300. Where the flow pathway 202 is in fluid communication with the port 204, an increase in flow resistance through the flow control module 300 can urge a greater portion of the fluid to flow to the flow pathway 202 rather than through the flow control module 300. Conversely, decreasing flow resistance through the flow control module 300 can urge a lesser portion of the fluid to flow to the flow pathway 202 and instead allow greater flow through the flow control module 300. Thus, by adjusting the rotational orientation of the blades 330, both an amount and speed of drilling fluid 400 through the flow control module 300 can be controlled.

According to one or more embodiments, as shown in FIGS. 3A-4C, a flow control module 300 can be provided to control flow of a fluid therethrough. The flow control module 300 can include one or more blades 330 distributed within the annulus 205 and radially between an inner body 310 and an outer body 320. The blades 330 can be evenly distributed (i.e., with radial symmetry) about a central axis 350 of the flow control module 300. While six blades 330 are shown in the exemplary embodiments of FIGS. 3A-4C, any number of blades 330 can be provided in any one of a variety of configurations. The flow control module 300 can further include a central channel 340 extending through the inner body 310.

According to one or more embodiments, each of the blades 330 can be rotatable with respect to a pivot section 360. The pivot section 360 can rotatably connect a corresponding blade 330 to the inner body 310 and/or the outer body 320. According to one or more embodiments, each of the blades 330 can rotate within an axis that is orthogonal to the central axis 350 of the flow control module 300. Alternatively or in combination, each of the blades 330 can rotate within an axis that is oblique or otherwise not orthogonal to the central axis 350.

According to one or more embodiments, each of the blades 330 can extend away from an axis of rotation (e.g., the pivot section 360). Each of the blades 330 can extend into opposite directions away from its axis of rotation. Each of the blades 330 can have bilateral symmetry across its axis of rotation. Accordingly, each blade 330 can form two segments that extend an equal or substantially equal distance away from the axis of rotation. Accordingly, the force of a flow 400 against the faces of these segments can generate minimal net torque on the blade 330.

Figure 3A:
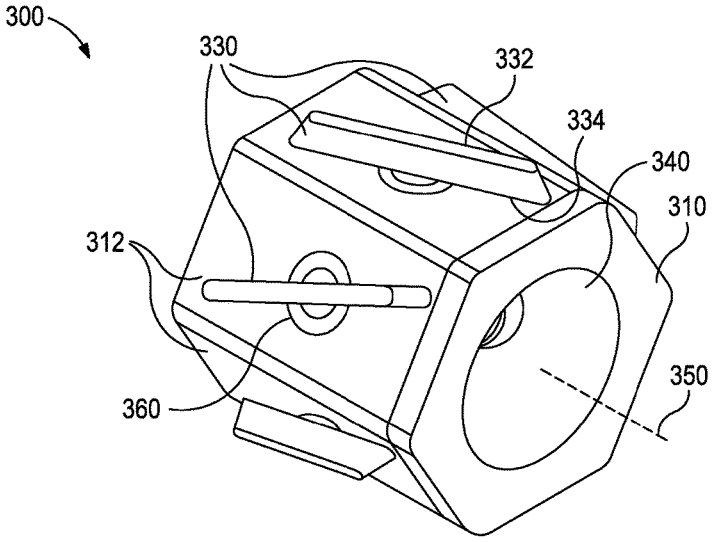
FIG. 3A shows a perspective view of an exemplary flow control module, according to one or more embodiments of the present disclosure.
Figure 3B:
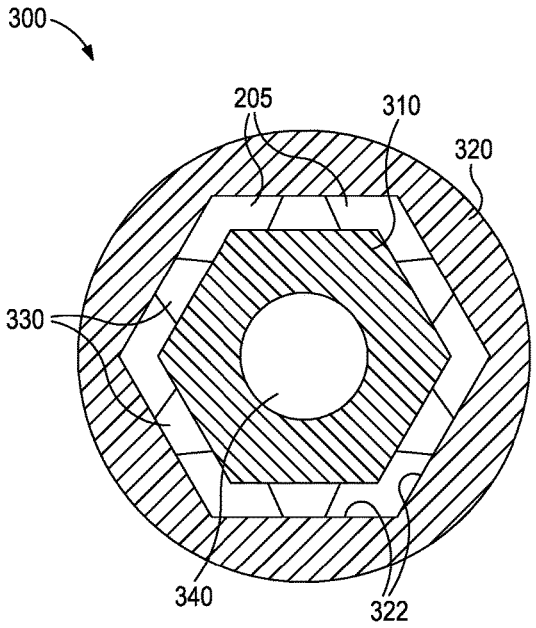
FIG. 3B shows a sectional view of an exemplary flow control module, according to one or more embodiments of the present disclosure.
Figure 4A:
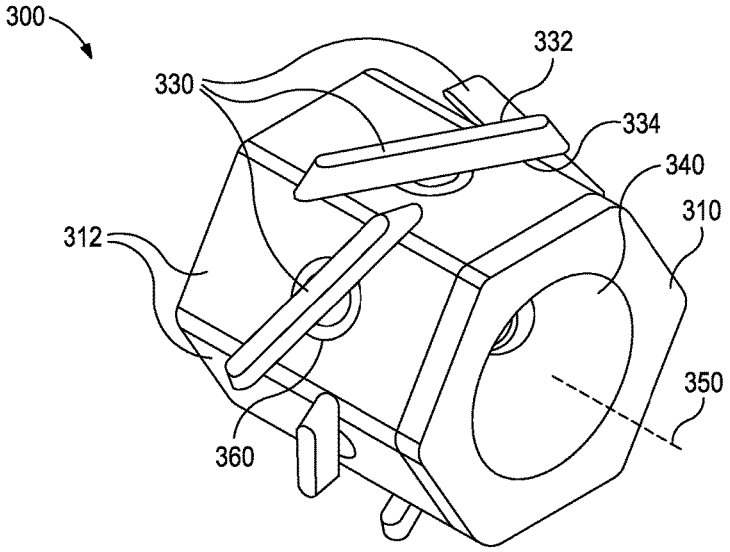
FIG. 4A shows a perspective view of an exemplary flow control module, according to one or more embodiments of the present disclosure.
Figure 4B:
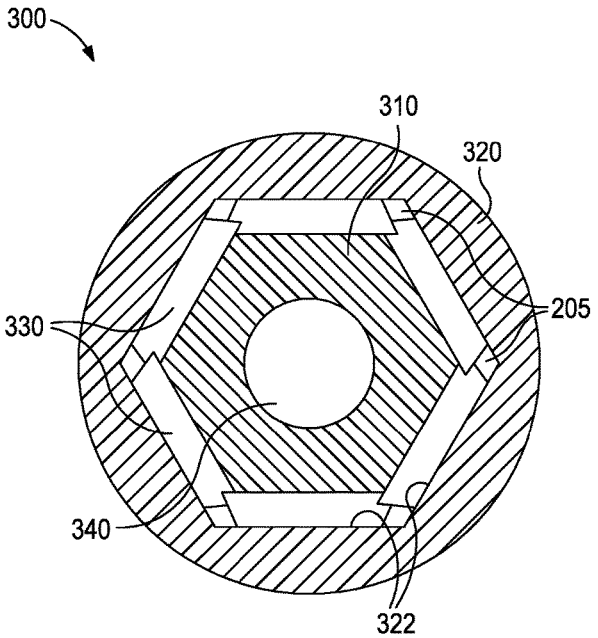
FIG. 4B shows a sectional view of an exemplary flow control module, according to one or more embodiments of the present disclosure.

According to one or more embodiments, the length of the blades 330 is such that the blades 330 can achieve full rotation about the pivot section 360 without contacting each other. Alternatively, the length of the blades 330 can be such that the blades 330 contact each other at certain rotational orientations about the pivot section 360. According to one or more embodiments, the inner edge 334 can be longer than the outer edge 332 of one or more of the blades 330. According to one or more embodiments, the inner edge 334 can be shorter than the outer edge 332 of one or more of the blades 330. According to one or more embodiments, one or more of the blades 330 provides a trapezoid shape in profile. As shown in FIGS. 3B and 4B, the rotational orientation of the blades 330 about the pivot section 360 can define a total axial flow area for the fluid to pass through the annulus 205.

Figure 3C:
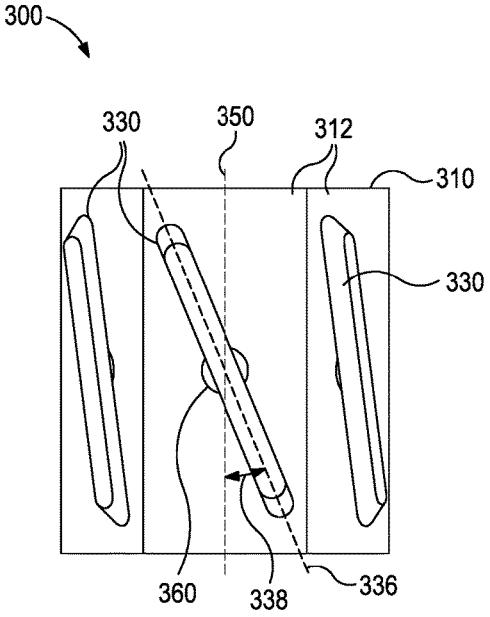
FIG. 3C shows a side view of an exemplary flow control module, according to one or more embodiments of the present disclosure.
Figure 4C:
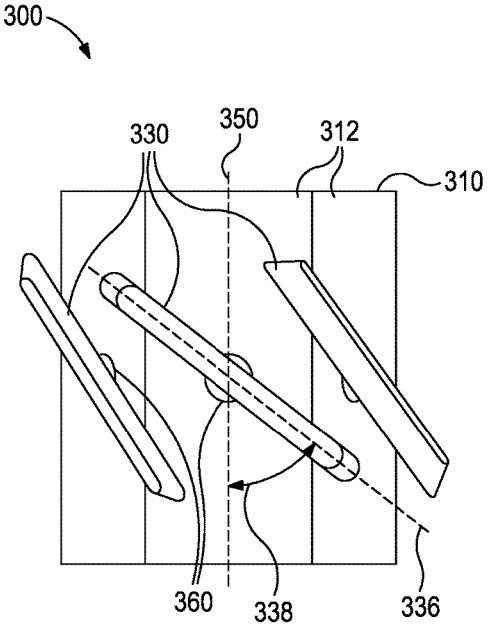
FIG. 4C shows a side view of an exemplary flow control module, according to one or more embodiments of the present disclosure.

According to one or more embodiments, as shown in FIGS. 3C and 4C, the blades 330 can rotate within a range of angles 338 formed by a direction 336 of a length of a blade 330 with respect to the central axis 350. The angle 338 can be reduced as the blade 330 is aligned with the central axis 350 and increased as the blade 330 is oriented more obliquely with respect to the central axis 350. According to one or more embodiments, at any given moment, each of the blades 330 can form the same angle 338 with respect to the central axis 350. Alternatively or in combination, at least some of the blades 330 can form different angles 338 with respect to the central axis 350.

According to one or more embodiments, the inner body 310 can provide one or more outer surfaces 312 facing radially outwardly from the central axis 350. One or more outer surfaces 312 can be provided for each of the blades 330. The inner body 310, along the outer surfaces 312, can form a polygonal shape in cross-section. An inner edge 334 of each blade 330 can provide a contour that remains flush against the corresponding outer surface 312 for a variety of orientations (i.e., angles 338) of the blade 330. According to one or more embodiments, the outer surface 312 and the inner edge 334 are both flat, such that the inner edge 334 remains flush against the outer surface 312 as the blade 330 rotates about the pivot section 360. Each of the outer surface 312 and the inner edge 334 can be aligned along a plane that is parallel to the central axis 350. Alternatively or in combination, the outer surface 312 and the inner edge 334 can be aligned along the same plane that is not parallel to the central axis 350. According to one or more embodiments, the outer surface 312 can provide a surface contour that has radial symmetry about the pivot section 360. For example, the outer surface 312 can be convex and the inner edge 334 can be concave with a similar radius of curvature, such that the inner edge 334 remains flush against the outer surface 312 as the blade 330 rotates about the pivot section 360. By further example, the outer surface 312 can be concave and the inner edge 334 can be convex with a similar radius of curvature, such that the inner edge 334 remains flush against the outer surface 312 as the blade 330 rotates about the pivot section 360.

According to one or more embodiments, the inner edge 334 of each blade 330 can provide a contour that maintains a constant distance to the outer surface 312 for a variety of orientations (i.e., angles 338) of the blade 330. Where the outer surface 312 and the inner edge 334 are both flat or have a similar radius of curvature, the distance between the inner edge 334 and the outer surface 312 can remain constant across a range of angles 338 as the blade 330 rotates about the pivot section 360. The distance between the inner edge 334 and the outer surface 312 can be zero or nonzero. The distance between the inner edge 334 and the outer surface 312 can be smaller than or larger than a radial dimension of the blade 330. The distance between the inner edge 334 and the outer surface 312 can provide a gap that allows flow of fluid there through for any orientation (i.e., angle 338) of the blade 330.

According to one or more embodiments, the outer body 320 can provide one or more inner surfaces 322 facing radially outwardly from the central axis 350. One or more inner surfaces 322 can be provided for each of the blades 330. The outer body 320, along the inner surfaces 322, can form a polygonal shape in cross-section. An outer edge 332 of each blade 330 can provide a contour that remains flush against the corresponding inner surface 322 for a variety of orientations (i.e., angles 338) of the blade 330. According to one or more embodiments, the inner surface 322 and the outer edge 332 are both flat, such that the outer edge 332 remains flush against the inner surface 322 as the blade 330 rotates about the pivot section 360. Each of the inner surface 322 and the outer edge 332 can be aligned along a plane that is parallel to the central axis 350. Alternatively or in combination, the inner surface 322 and the outer edge 332 can be aligned along the same plane that is not parallel to the central axis 350. According to one or more embodiments, the inner surface 322 can provide a surface contour that has radial symmetry about the pivot section 360. For example, the inner surface 322 can be convex and the outer edge 332 can be concave with a similar radius of curvature, such that the outer edge 332 remains flush against the inner surface 322 as the blade 330 rotates about the pivot section 360. By further example, the inner surface 322 can be concave and the outer edge 332 can be convex with a similar radius of curvature, such that the outer edge 332 remains flush against the inner surface 322 as the blade 330 rotates about the pivot section 360.

According to one or more embodiments, the outer edge 332 of each blade 330 can provide a contour that maintains a constant distance to the inner surface 322 for a variety of orientations (i.e., angles 338) of the blade 330. Where the inner surface 322 and the outer edge 332 are both flat or have a similar radius of curvature, the distance between the outer edge 332 and the inner surface 322 can remain constant across a range of angles 338 as the blade 330 rotates about the pivot section 360. The distance between the outer edge 332 and the inner surface 322 can be zero or nonzero. The distance between the outer edge 332 and the inner surface 322 can be smaller than or larger than a radial dimension of the blade 330. The distance between the outer edge 332 and the inner surface 322 can be smaller than or larger than the distance between the inner edge 334 and the outer surface 312. The distance between the outer edge 332 and the inner surface 322 can provide a gap that allows flow of fluid there through for any orientation (i.e., angle 338) of the blade 330.

According to one or more embodiments, an exemplary method for controlling the direction of a drilling assembly within a borehole may include positioning a steering assembly 200 within a borehole. The steering assembly 200 may include a housing 201, a flow control module 300 disposed within the housing 201, a fluid-controlled drive mechanism 209 in fluid communication with the flow control module 300; and an offset mandrel 212 coupled to the fluid-controlled drive mechanism 209.

According to one or more embodiments, the steering assembly 200 may rotate a bit shaft 216 pivotably coupled to the housing 201. The bit shaft 216 may be partially disposed in an eccentric receptacle 217 of the offset mandrel 212. The housing 201 may impart torque on the bit shaft 216. Moreover, the fluid controlled drive mechanism 209 may generate torque via a turbine and a mud motor, and the steering assembly 200 may further generate power via a generator coupled to the fluid-controlled drive mechanism 209.

According to one or more embodiments, the offset mandrel 212 can be rotated independently from the housing 201, and a rotational speed of the offset mandrel 212 can be varied by altering the flow control module 300. According to one or more embodiments, altering the flow control module 300 may include changing a fluid flow characteristic through the flow control module 300 using one or more blades 330 to change the flow area and thereby the flow velocity through the flow control module 300. For example, one or more of the blades 330 can rotate about a pivot 362 form an angle 338 that is more or less oblique relative to a central axis 350 of the flow control module 300.

According to one or more embodiments, the flow control module 300 can be operated based on measurements and inputs detected by or received by control modules operably connected to the flow control module 300. The control modules can calculate relative and/or absolute rotation of the fluid controlled drive mechanism 209, the offset mandrel 212, the housing 201, and/or the bit shaft 216. The control modules can further calculate volumetric flow rate of a drilling fluid. Based on measurements and other inputs, an amount, degree, or rate of rotation imparted by the drive mechanism 209 to the offset mandrel 212 can be determined in order to maintain the offset mandrel 212 in a geostationary orientation. Based on analysis of these measurements and inputs, a rotational orientation of one or more blades 330 of the flow control module 300 can be determined to achieve the desired outcome. The flow control module 300 can be operated according to such determinations to maintain the offset mandrel 212 in a geostationary orientation or other controlled and/or desirable orientation. The above method can be repeated on a continuing basis and the operation of the flow control module 300 can be automatically adjusted. If desired, this methodology may be repeated on a "real-time" basis. As used herein and in the appended claims, the term "real-time" and variations thereof means actual real-time, nearly real-time or frequently. As used herein and in the appended claims, the term "automatic" and variations thereof means the capability of accomplishing the relevant task(s) without human involvement or intervention. The frequency of repetition of this process may be set, or varied, as is desired. For example, the frequency of repetition may be established or changed based upon the particular borehole conditions or type.

According to one or more embodiments, the offset mandrel 212 may be at least partially disposed within an eccentric cam (not shown) coupled to the output of the fluid controlled drive mechanism 209. Additionally, the offset mandrel 212 may be coupled to a motor that is configured to rotate the offset mandrel 212 independently from the eccentric cam. As is described above, the motor may rotate the offset mandrel 212 with respect to the eccentric cam to alter a drilling angle of the steering assembly 200.

According to one or more embodiments, another exemplary method for controlling the orientation of a component of a drilling assembly 200 within a borehole may include positioning a steering assembly 200 within a borehole, wherein the steering assembly 200 includes an offset mandrel 212 coupled to a bit shaft 216. The method may also include rotating the offset mandrel 212 with a motor coupled to offset mandrel 212. Rotating the offset mandrel 212 with the motor may alter a longitudinal axis 219 of the bit shaft 216. The method may also include changing a rotational speed of the offset mandrel 212 by changing a fluid flow characteristic through a flow control module 300 using one or more blades to change the flow area and thereby the flow velocity through the flow control module 300 as well as the fluid-controlled drive mechanism 209.

Embodiments disclosed herein include:

A flow control module, including: an inner body and an outer body, defining an annulus there between; one or more blades within the annulus, each of the blades being rotatable to provide a range of angles with respect to a longitudinal axis of the flow control module; wherein an outer edge of each of the blades maintains a constant distance to an inner surface of the outer body across the range of angles; wherein an inner edge of each of the blades maintains a constant distance to an outer surface of the inner body across the range of angles.

A tool string, including: a bit shaft rotatable about a longitudinal axis of the bit shaft; an offset mandrel for adjusting the longitudinal axis of the bit shaft; a drive mechanism configured to rotate the offset mandrel independently of the bit shaft; a flow control module configured to direct a fluid flow to the drive mechanism and including: an inner body and an outer body, defining an annulus there between; one or more blades within the annulus, each of the blades being rotatable to provide a range of angles with respect to a longitudinal axis of the flow control module; a controller configured to adjust the blades such that the drive mechanism is maintained in a substantially geostationary position and rotates in a direction opposite of a rotational direction of the bit shaft.

A method, including: controlling a rotation and/or position of a bit shaft about a longitudinal axis of the bit shaft; controlling a rotation and/or position of an offset mandrel coupled to at least a portion of the bit shaft by adjusting one or more blades of a flow control module to direct a fluid flow to a drive mechanism coupled to the offset mandrel.

Each of embodiments A, B, and C may have one or more of the following additional elements in any combination:

Element 1: the outer edge and the inner surface can be flat; and wherein the inner edge and the outer surface can be flat. Element 2: each of the outer edge, the inner surface, the inner edge, and the outer surface can be parallel to the longitudinal axis. Element 3: the outer edge can be concave and the inner surface can be convex, or the outer edge can be convex and the inner surface can be concave. Element 4: the inner edge can be concave and the outer surface can be convex, or the inner edge can be convex and the outer surface can be concave. Element 5: each of the blades can be bilaterally symmetric across its axis of rotation. Element 6: an outer edge of each of the blades can remain flush against an outer surface of the outer body across the range of angles; and an inner edge of each of the blades can remain flush against an inner surface of the inner body across the range of angles. Element 7: each of the outer edge, the outer surface, the inner edge, and the inner surface can be parallel to the longitudinal axis of the flow control module. Element 8: adjusting the blades can include adjusting a total cross-sectional flow area through the annulus of the flow control module. Element 9: adjusting the blades can include adjusting a flow direction through the annulus of the flow control module. Element 10: controlling an orientation of the longitudinal axis of the bit shaft can include adjusting the offset mandrel. Element 11: an operating characteristic can be detected, including at least one of a rotational speed of the bit shaft, an angular orientation of the bit shaft, and a volumetric flow rate of a drilling fluid through the flow control module. Element 12: adjusting the one or more blades can be based on detection of the operating characteristic. Element 13: controlling the rotation of the offset mandrel can include rotating the offset mandrel at a speed substantially equal to a rotational speed of the bit shaft and in a direction opposite of a rotational direction of the bit shaft. Element 14: controlling the rotation of the offset mandrel can include maintaining the offset mandrel in a geostationary position or orientation relative to a formation of the earth and/or a wellbore. Element 15: adjusting the one or more blades can include rotating the one or more blades about an axis orthogonal to a central axis of the flow control module. Element 16: the inner body and the outer body can each define, in cross-section. a polygonal shape defining a boundary of the annulus. Element 17: the annulus can define an inlet on a first longitudinal side of the flow control module and an outlet on a second longitudinal side of the flow control module to provide flow through the annulus from the inlet, past the one or more blades, to the outlet. Element 18: an orientation of the one or more blades can provide a flow direction for a fluid that contacts a rotor of the drive mechanism.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A flow control module, comprising:

an inner body and an outer body, defining an annulus there between;

one or more blades within the annulus, each of the blades rotatably connected to the inner body or the outer body with a pivot section, each pivot section defining an axis of rotation for each of the blades, each axis of rotation providing a range of angles with respect to a longitudinal axis of the flow control module, wherein each of the blades is bilaterally symmetrical about the axis of rotation and includes a first segment and a second segment that extend into opposite directions an equal distance away from the axis of rotation;

wherein an outer edge of each of the blades maintains a constant distance to an inner surface of the outer body across the range of angles;

wherein an inner edge of each of the blades maintains a constant distance to an outer surface of the inner body across the range of angles.

2. The flow control module of claim 1, wherein the outer edge and the inner surface are flat; and wherein the inner edge and the outer surface are flat.

3. The flow control module of claim 1, wherein each of the outer edge, the inner surface, the inner edge, and the outer surface are parallel to the longitudinal axis.

4. The flow control module of claim 1, wherein the outer edge is concave and the inner surface is convex, or the outer edge is convex and the inner surface is concave.

5. The flow control module of claim 1, wherein the inner edge is concave and the outer surface is convex, or the inner edge is convex and the outer surface is concave.

6. The flow control module of claim 1, wherein the inner body and the outer body each define, in cross-section, a polygonal shape defining a boundary of the annulus.

7. The flow control module of claim 1, wherein the annulus defines an inlet on a first longitudinal side of the flow control module and an outlet on a second longitudinal side of the flow control module to provide flow through the annulus from the inlet, past the one or more blades, to the outlet.

8. A tool string, comprising:

a bit shaft rotatable about a longitudinal axis of the bit shaft;

an offset mandrel for adjusting the longitudinal axis of the bit shaft;

a drive mechanism configured to rotate the offset mandrel independently of the bit shaft;

a flow control module configured to direct a fluid flow to the drive mechanism and including:

an inner body and an outer body, defining an annulus there between; and one or more blades within the annulus, each of the blades rotatably connected to the inner body or the outer body with a pivot section, each pivot section defining an axis of rotation for each of the blades, each axis of rotation providing a range of angles with respect to a longitudinal axis of the flow control module, wherein each of the blades is bilaterally symmetrical about the axis of rotation and includes a first segment and a second segment that extend into opposite directions an equal distance away from the axis of rotation; and a controller configured to adjust the blades such that the drive mechanism is maintained in a substantially geostationary position and rotates in a direction opposite of a rotational direction of the bit shaft.

9. The tool string of claim 8, wherein an outer edge of each of the blades remains flush against an inner surface of the outer body across the range of angles; and wherein an inner edge of each of the blades remains flush against an outer surface of the inner body across the range of angles.

10. The tool string of claim 9, wherein the outer edge and the outer surface are flat; and wherein the inner edge and the inner surface are flat.

11. The tool string of claim 10, wherein each of the outer edge, the outer surface, the inner edge, and the inner surface are parallel to the longitudinal axis of the flow control module.

12. The tool string of claim 8, wherein the inner body and the outer body each define, in cross-section, a polygonal shape defining a boundary of the annulus.

13. The tool string of claim 8, wherein the annulus defines an inlet on a first longitudinal side of the flow control module and an outlet on a second longitudinal side of the flow control module to provide flow through the annulus from the inlet, past the one or more blades, to the outlet.

14. The tool string of claim 8, wherein an orientation of the one or more blades provides a flow direction for a fluid that contacts a rotor of the drive mechanism.

15. A method, comprising:

controlling a rotation and/or position of a bit shaft about a longitudinal axis of the bit shaft;

controlling a rotation and/or position of an offset mandrel coupled to at least a portion of the bit shaft by adjusting one or more blades of a flow control module to direct a fluid flow to a drive mechanism coupled to the offset mandrel, wherein each of the blades is rotatably connected to the flow control module with a pivot section, each pivot section defining an axis of rotation for each of the blades, and each of the blades is bilaterally symmetrical about the axis of rotation and includes a first segment and a second segment that extend into opposite directions an equal distance away from the axis of rotation.

16. The method of claim 15, wherein adjusting the blades includes adjusting a total cross-sectional flow area through the annulus of the flow control module.

17. The method of claim 15, wherein adjusting the blades includes adjusting a flow direction through the annulus of the flow control module.

18. The method of claim 15, further comprising controlling an orientation of the longitudinal axis of the bit shaft by adjusting the offset mandrel.

19. The method of claim 15, further comprising detecting an operating characteristic including at least one of a rotational speed of the bit shaft, an angular orientation of the bit shaft, and a volumetric flow rate of a drilling fluid through the flow control module.

20. The method of claim 19, wherein adjusting the one or more blades is based on detection of the operating characteristic.

21. The method of claim 15, wherein controlling the rotation of the offset mandrel includes rotating the offset mandrel at a speed substantially equal to a rotational speed of the bit shaft and in a direction opposite of a rotational direction of the bit shaft.

22. The method of claim 15, wherein controlling the rotation of the offset mandrel includes maintaining the offset mandrel in a geostationary position or orientation relative to a formation of the earth and/or a wellbore.

23. The method of claim 15, wherein adjusting the one or more blades includes rotating the one or more blades about an axis orthogonal to a central axis of the flow control module.

* * * * *